US012628879B2

(12) United States Patent
Kim et al.

(10) Patent No.: US 12,628,879 B2
(45) Date of Patent: May 19, 2026

(54) AEROSOL GENERATING DEVICE AND AEROSOL GENERATING METHOD FOR PERFORMING MULTICALIBRATION ON TEMPERATURE VALUE MEASURED BY TEMPERATURE SENSOR

(71) Applicant: KT&G CORPORATION, Daejeon (KR)

(72) Inventors: Yong Hwan Kim, Gyeonggi-do (KR); Sung Wook Yoon, Gyeonggi-do (KR); Seung Won Lee, Gyeonggi-do (KR); Seok Su Jang, Daejeon (KR); Dae Nam Han, Seoul (KR)

(73) Assignee: KT&G CORPORATION, Daejeon (KR)

( * ) Notice: Subject to any disclaimer, the term of this patent is extended or adjusted under 35 U.S.C. 154(b) by 674 days.

(21) Appl. No.: 17/912,696

(22) PCT Filed: Jul. 26, 2021

(86) PCT No.: PCT/KR2021/009660

§ 371 (c)(1),
(2) Date: Sep. 19, 2022

(87) PCT Pub. No.: WO2022/025573

PCT Pub. Date: Feb. 3, 2022

(65) Prior Publication Data

US 2023/0113304 A1 Apr. 13, 2023

(30) Foreign Application Priority Data

Jul. 27, 2020 (KR) ..... 10-2020-0093174

(51) Int. Cl.

| | |
|---|---|
| ***A24F 40/57*** | (2020.01) |
| ***A24F 40/51*** | (2020.01) |
| *A24F 40/42* | (2020.01) |

(52) U.S. Cl.

CPC ..... *A24F 40/57* (2020.01); *A24F 40/51* (2020.01); *A24F 40/42* (2020.01)

(58) Field of Classification Search

None

See application file for complete search history.

(56) References Cited

U.S. PATENT DOCUMENTS

2019/0313698 A1 10/2019 Kuczaj
2019/0342950 A1 11/2019 Bernauer et al.

(Continued)

FOREIGN PATENT DOCUMENTS

CN 104470386 A 3/2015
CN 107407941 A 11/2017

(Continued)

OTHER PUBLICATIONS

KR20200057488A, Aerosol Generating Device and Method of Controlling Same, (Year: 2020).*

(Continued)

*Primary Examiner* — Katherine A Will

(74) *Attorney, Agent, or Firm* — Sughrue Mion, PLLC

(57) ABSTRACT

An aerosol generating device may include: a heater configured to apply heat to an aerosol generating substrate; a temperature sensor configured to measure a temperature of the heater to obtain a measured temperature value; and a processor configured to: control power supplied to the heater; add a first calibration value to the measured temperature value to obtain a first calibrated temperature value; add a second calibration value to the first calibrated temperature value to obtain a second calibrated temperature value; and determine the second calibrated temperature value as the temperature of the heater.

7 Claims, 10 Drawing Sheets

(56) References Cited

U.S. PATENT DOCUMENTS

| | | | |
|---|---|---|---|
| 2020/0107579 | A1 | 4/2020 | Courbat et al. |
| 2020/0163386 | A1 | 5/2020 | Courbat et al. |
| 2021/0000185 | A1 | 1/2021 | Jung et al. |
| 2021/0186114 | A1 | 6/2021 | Lee |

FOREIGN PATENT DOCUMENTS

| | | | |
|---|---|---|---|
| CN | 111246764 | A | 6/2020 |
| EP | 3 524 070 | A1 | 8/2019 |
| JP | 2009-103572 | A | 5/2009 |
| KR | 10-2016-0117676 | A | 10/2016 |
| KR | 10-2018-0111460 | A | 10/2018 |
| KR | 10-2019-0010433 | A | 1/2019 |
| KR | 10-2019-0016622 | A | 2/2019 |
| KR | 10-2020-0057488 | A | 5/2020 |
| WO | 2018/019786 | A1 | 2/2018 |

OTHER PUBLICATIONS

English translation of Jung et al. (KR 10-2020-0057488) (Year: 2020).*
English translation of Hirayama (JP2009103572A) (Year: 2009).*
Japanese Office Action dated Nov. 14, 2023 in Application No. 2022-558547.
Office Action issued May 14, 2024 in Chinese Application No. 202180013334.0.
Communication dated Oct. 25, 2022 from the Korean Intellectual Property Office in Application No. 10-2020-0093174.
US 11,350,663 B2, 07/2022, Han et al. (withdrawn)
Korean Notice of Non-final Rejection for 10-2020-0093174, dated Apr. 1, 2022.
International Search Report for PCT/KR2021/009660, dated Nov. 22, 2021.
Written Opinion for PCT/KR2021/009660, dated Nov. 22, 2021.

* cited by examiner

[Fig. 1]
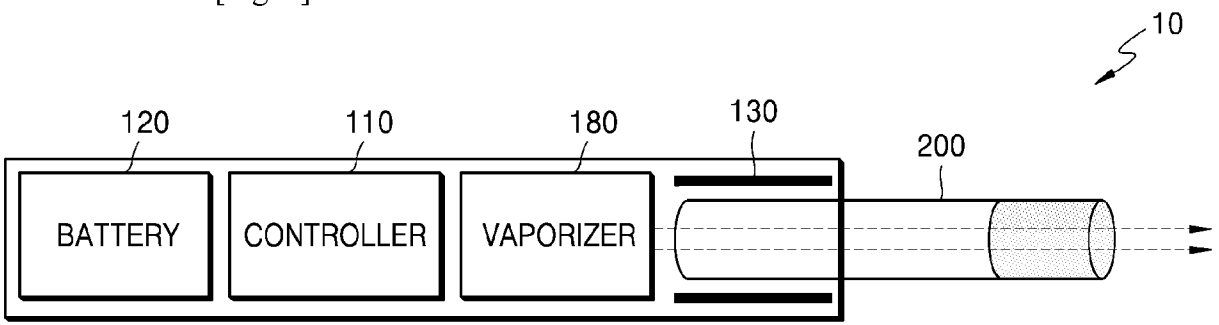
[Fig. 2]
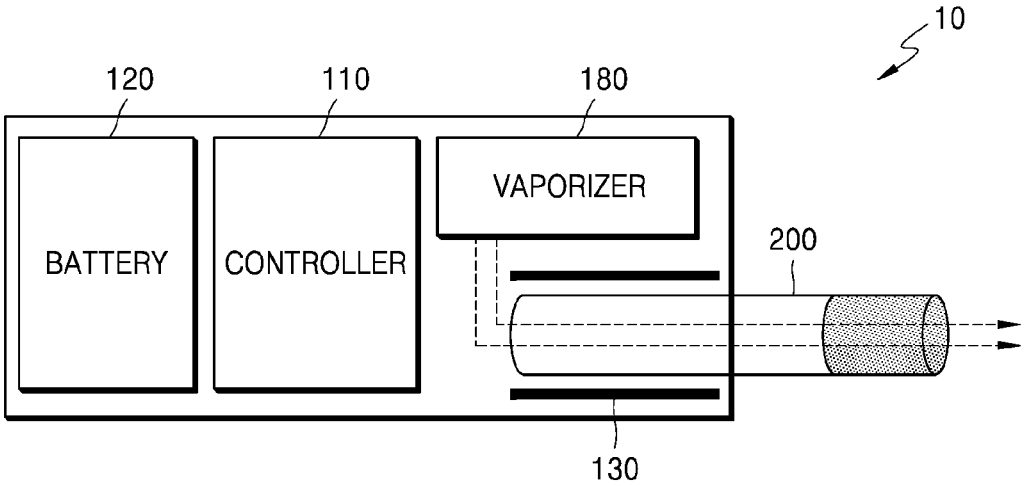

[Fig. 3]
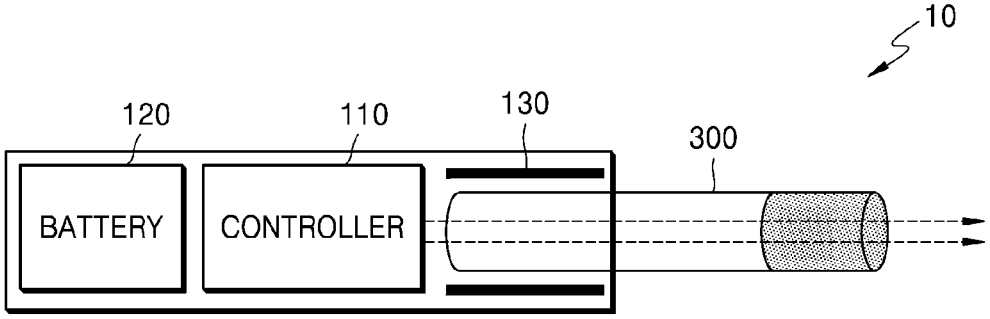
[Fig. 4]
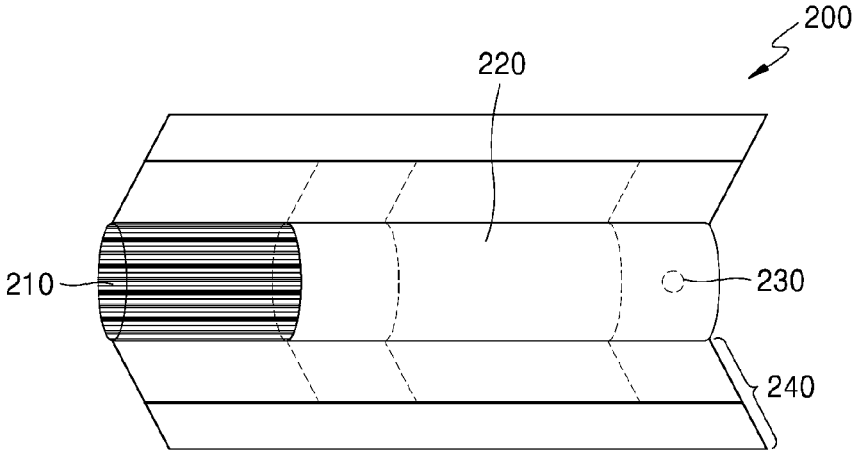
[Fig. 5]
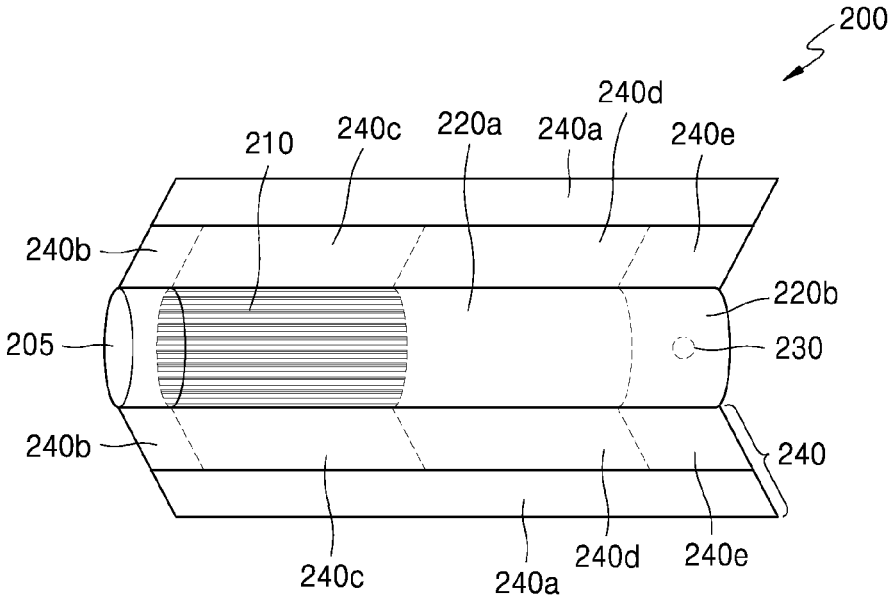

[Fig. 6]
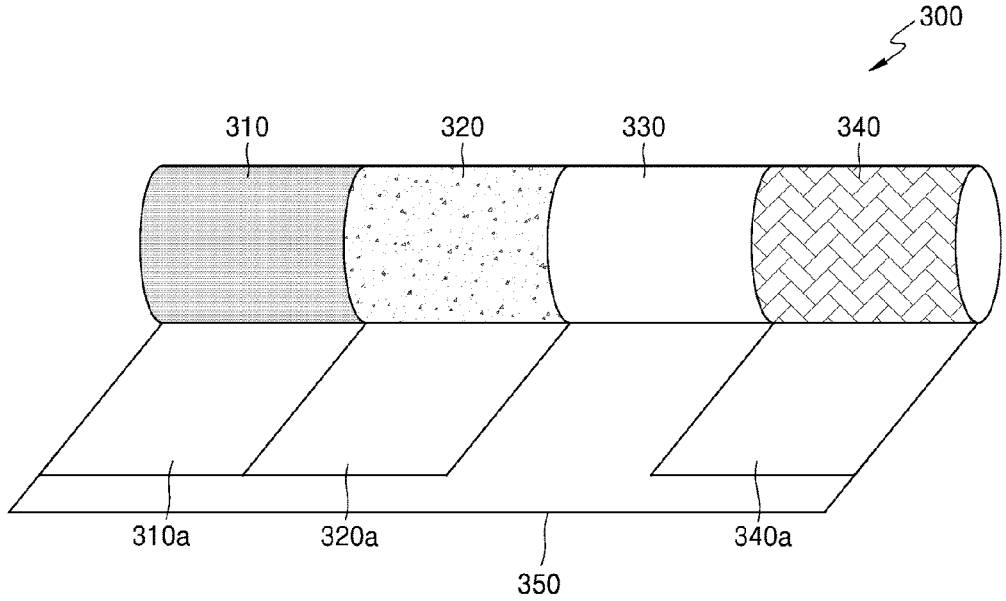

[Fig. 7]
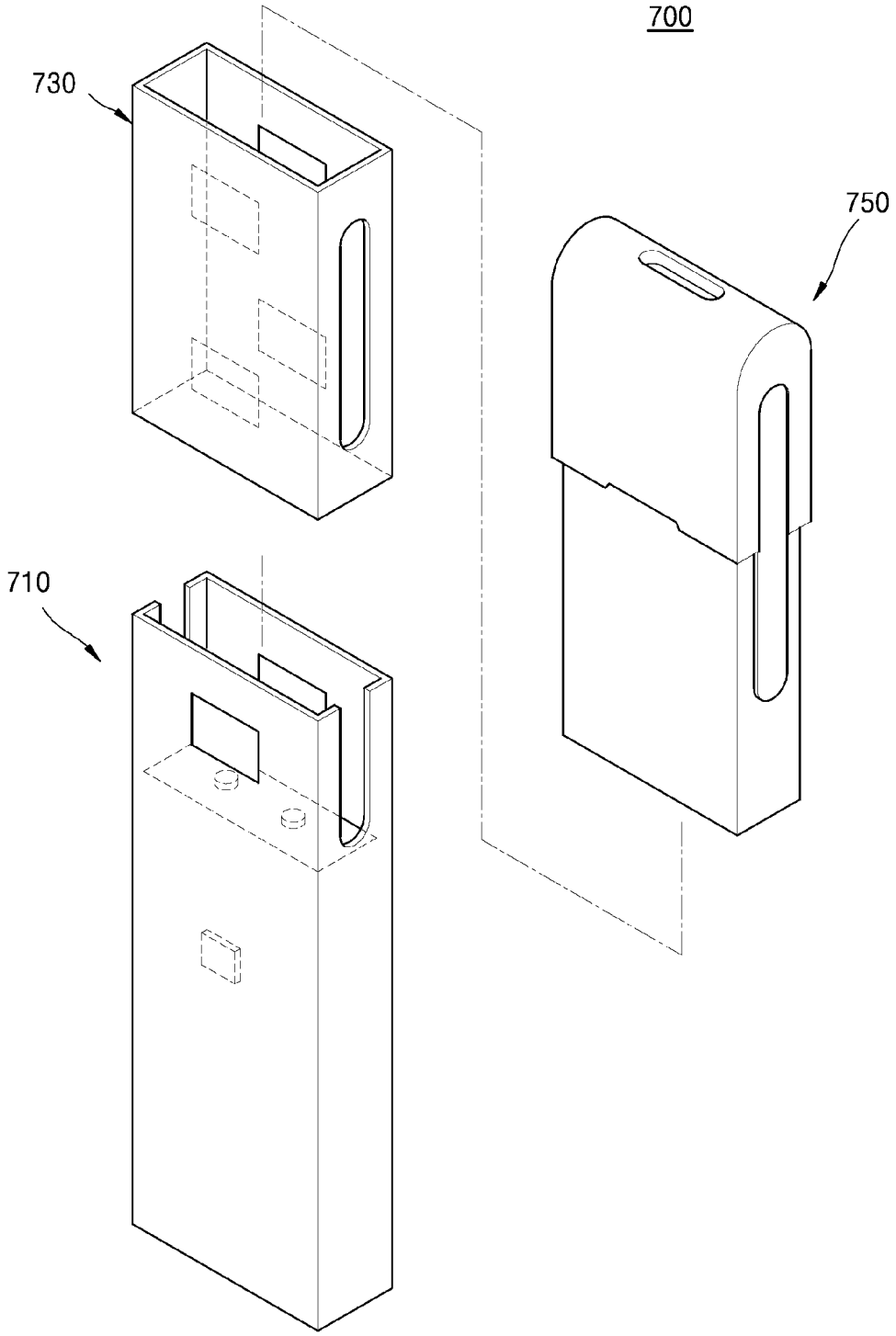

[Fig. 8]
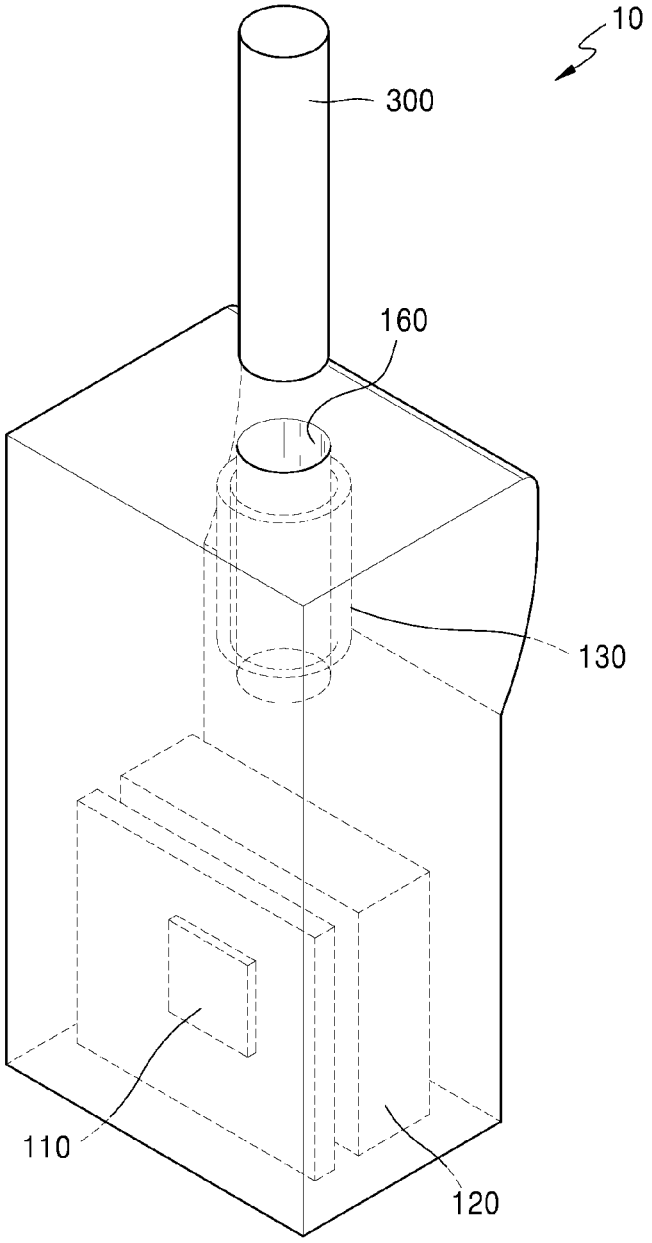

[Fig. 9]
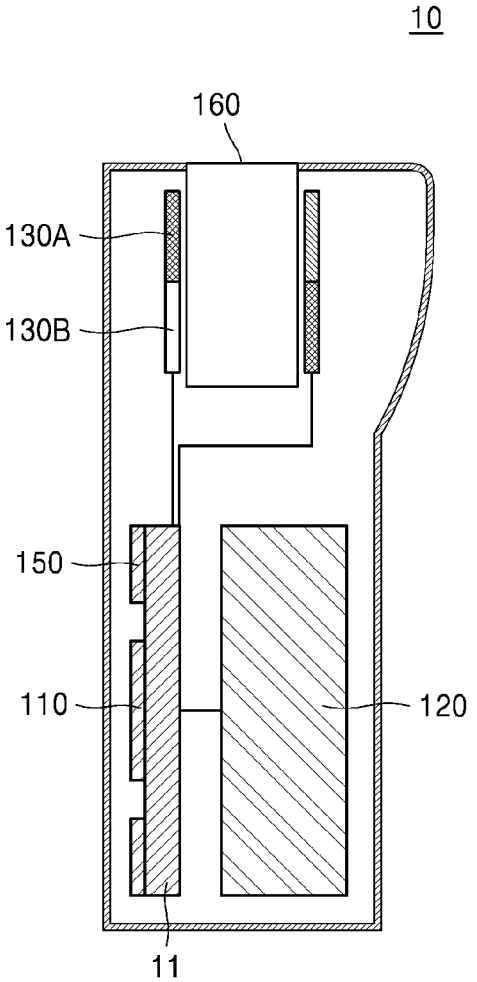
[Fig. 10]
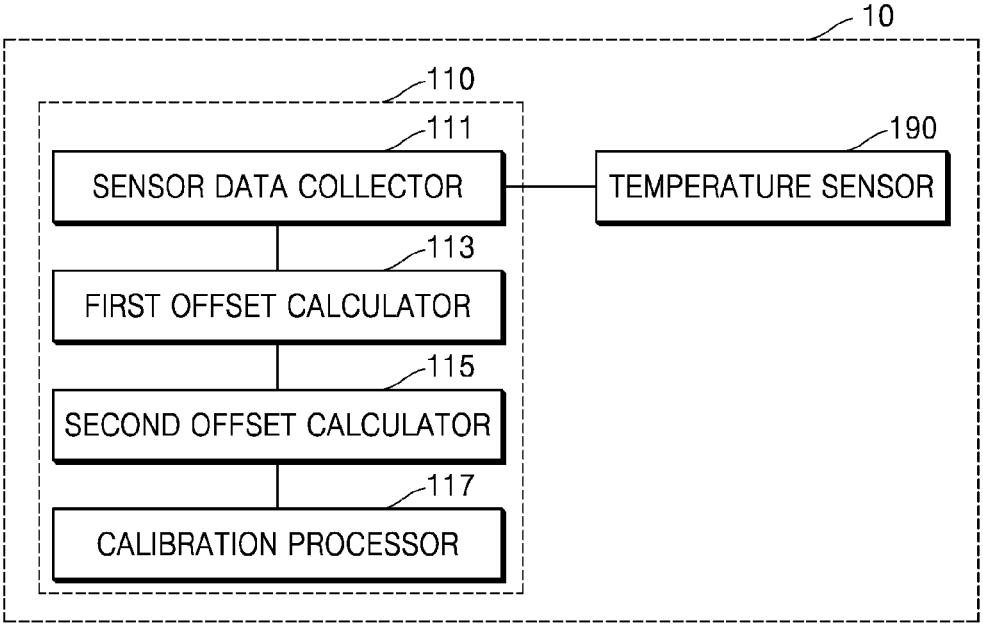

[Fig. 11]
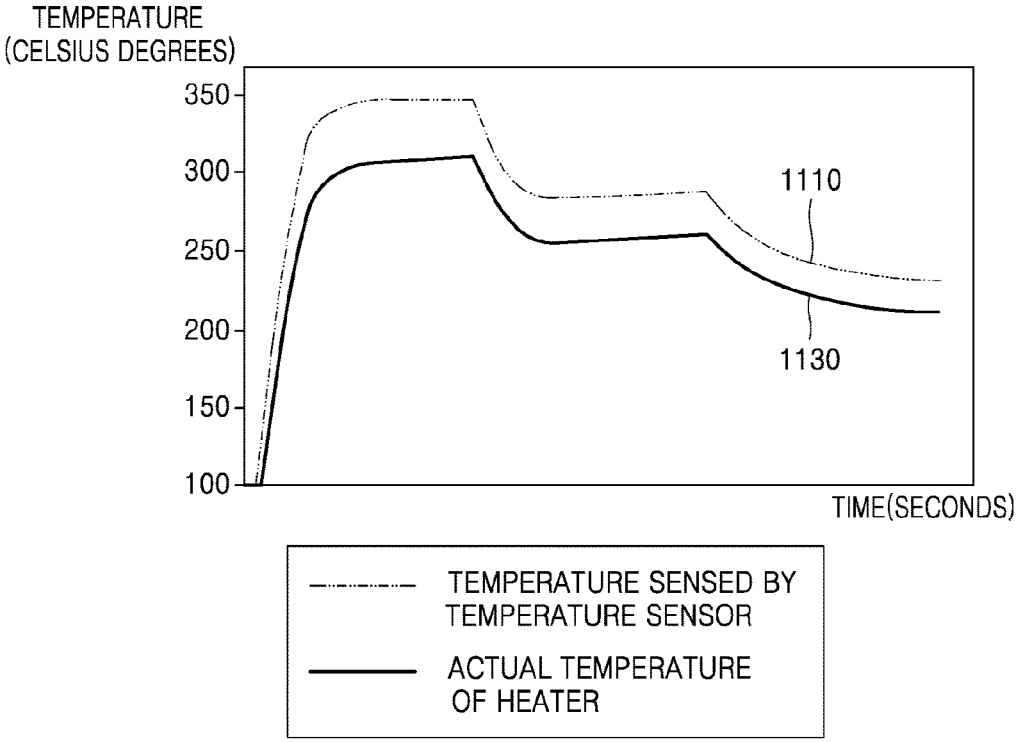

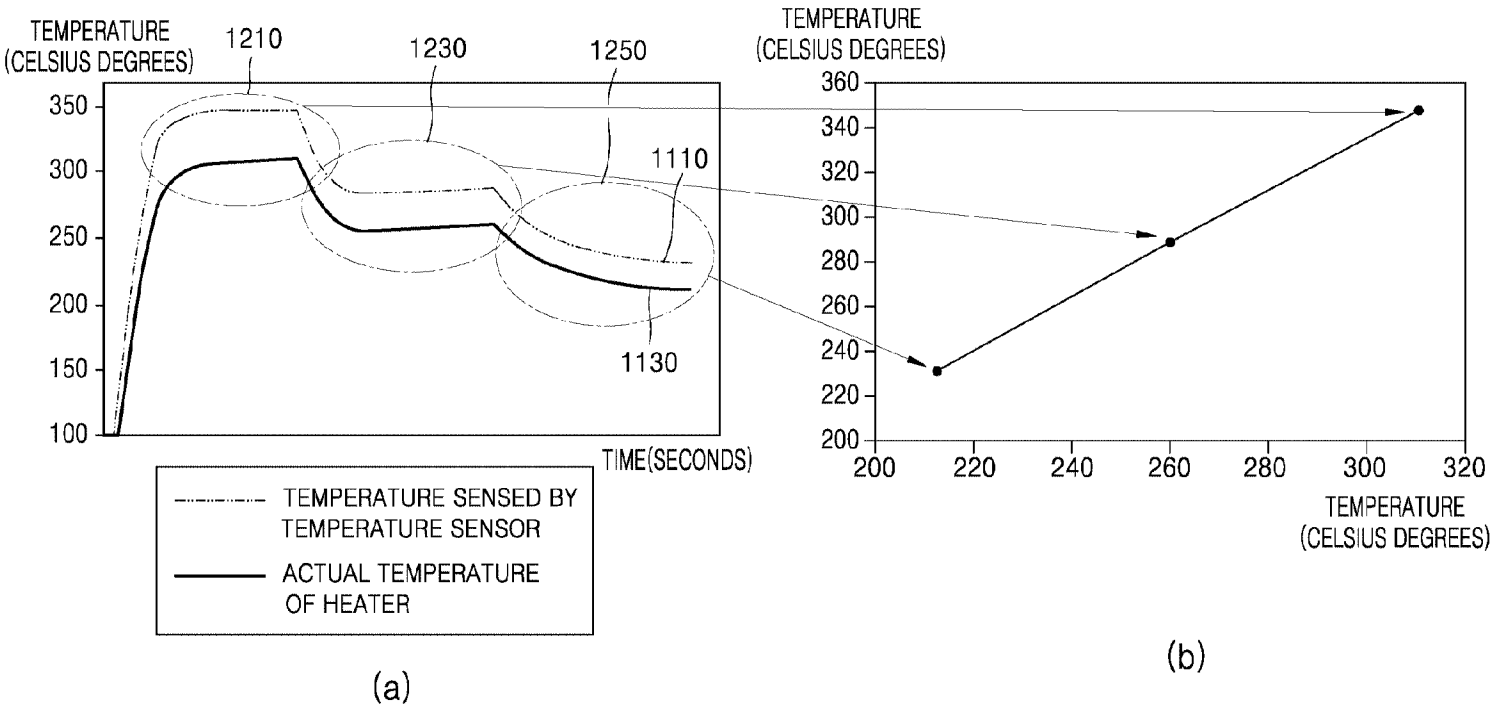
[Fig. 12]

[Fig. 13]
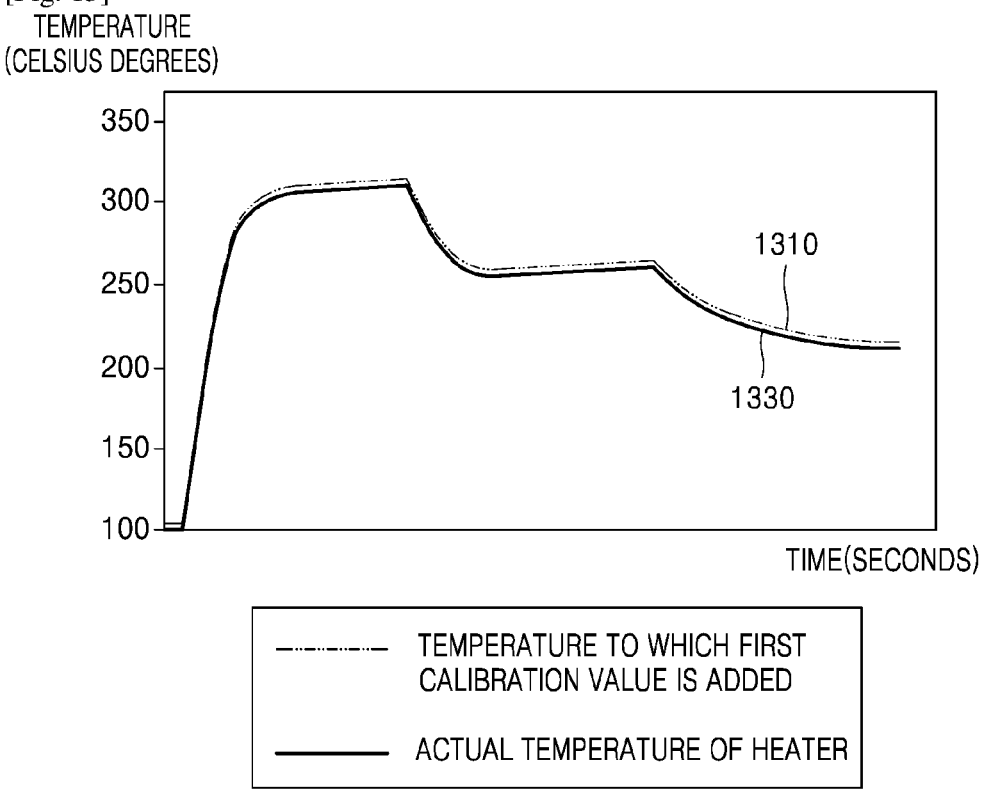
[Fig. 14]
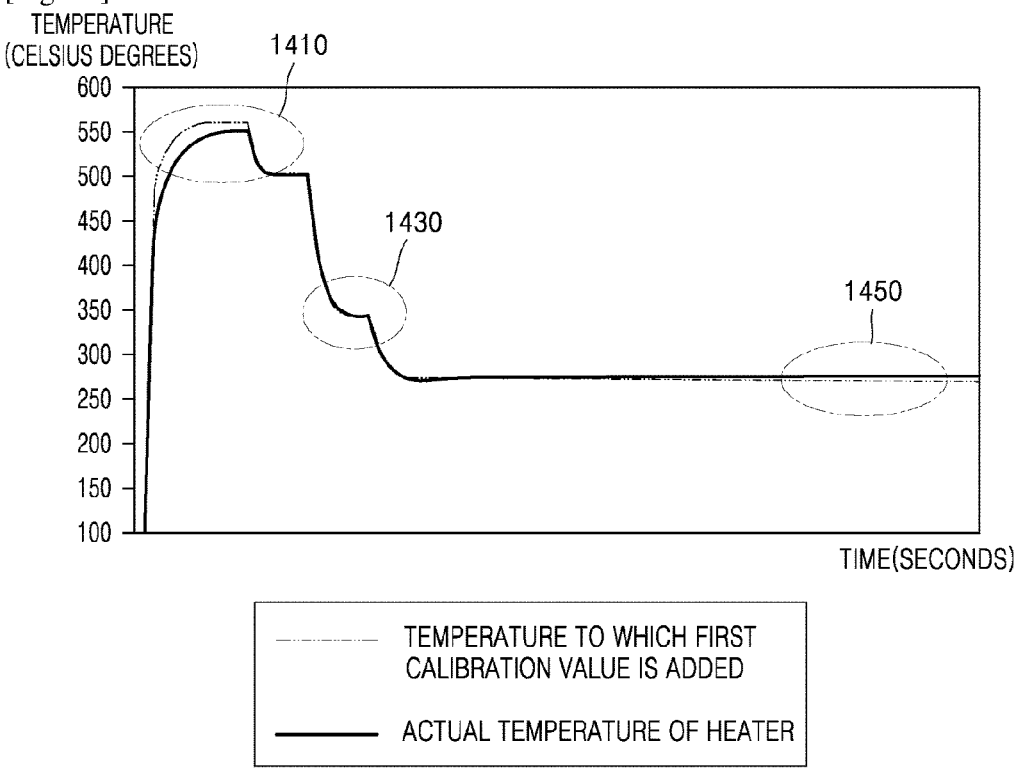

[Fig. 15]
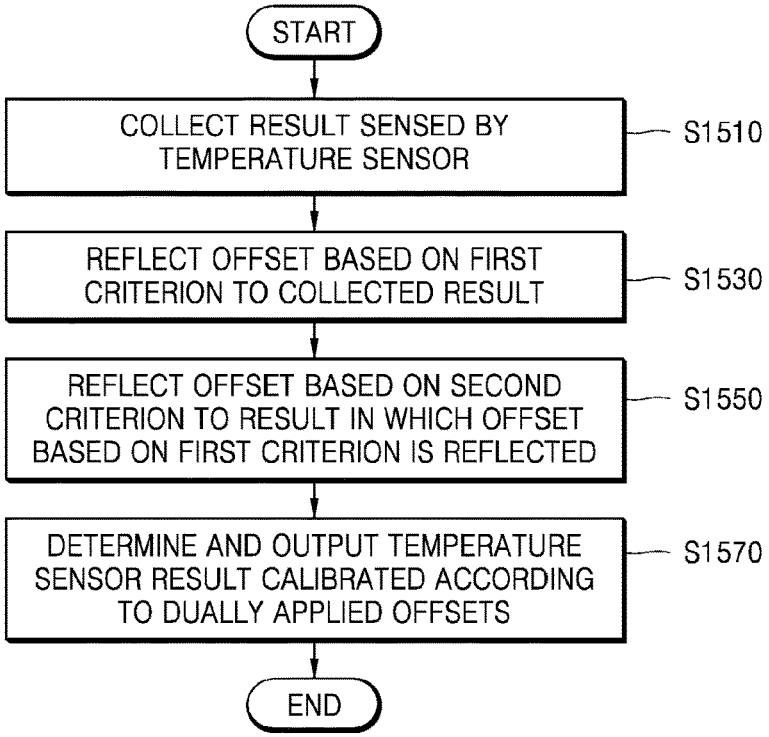
[Fig. 16]
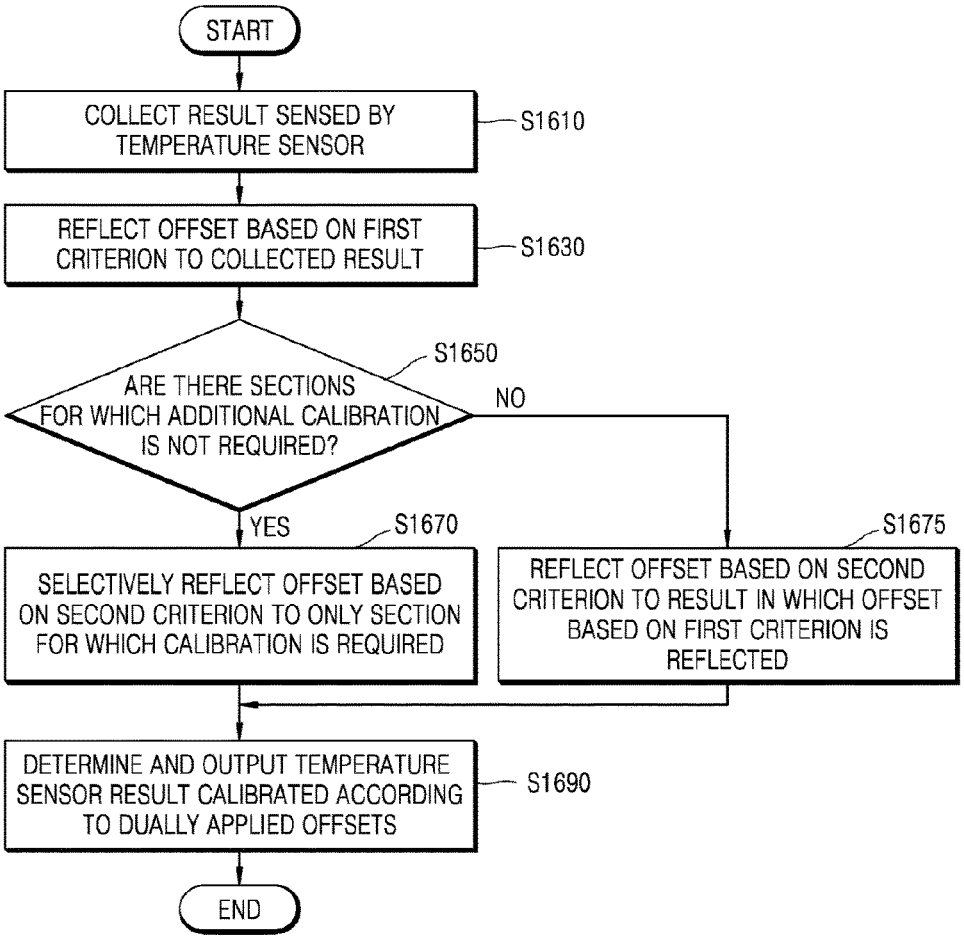

AEROSOL GENERATING DEVICE AND AEROSOL GENERATING METHOD FOR PERFORMING MULTICALIBRATION ON TEMPERATURE VALUE MEASURED BY TEMPERATURE SENSOR

CROSS REFERENCE TO RELATED APPLICATIONS

This application is a National Stage of International Application No. PCT/KR2021/009660 filed Jul. 26, 2021, claiming priority based on Korean Patent Application No. 10-2020-0093174 filed Jul. 27, 2020.

TECHNICAL FIELD

The disclosure relates to an aerosol generating device and an aerosol generating method for performing multicalibration on a temperature value measured by a temperature sensor, and more particularly, to an aerosol generating device and an aerosol generating method performing calibration on a temperature of a heater measured by a temperature sensor included in the aerosol generating device, thereby to enhance the accuracy of the temperature measurement.

BACKGROUND ART

Recently, there has been increasing demand for alternative ways of overcoming the disadvantages of common cigarettes. For example, there is an increasing demand for a method of generating aerosol by heating an aerosol generating material in cigarettes, rather than by burning cigarettes. Accordingly, research into a heating-type cigarette or a heating-type aerosol generator has been actively conducted.

The aerosol generating device is an electronic cigarette focused on portability and includes a temperature sensor configured to measure the temperature of a heater and control power supplied to the heater. The heater of the aerosol generating device may be heated to a maximum temperature that is greater than 300 Celsius degrees according to an aerosol generating substrate that is heated. Thus, generally, the temperature sensor for measuring the temperature of the heater is not directly coupled to the heater.

Due to this location characteristic of the temperature sensor, the temperature measured by the temperature sensor may not match an actual temperature of the heater. Thus, a microcontroller included in the aerosol generating device may receive a temperature value measured by the temperature sensor and perform a series of calibration processes to determine a final temperature of the heater, and then, according to the final temperature, control power supplied to the heater.

In order to accurately measure a temperature of the heater, an aerosol generating device in the related art includes an infrared (IR) measuring device configured to measure the temperature by radiating infrared rays to the heater. However, due to cost issues, temperature measurements using an IR sensor may not be commercially feasible for aerosol generating devices.

DISCLOSURE OF INVENTION

Technical Problem

A technical objective to be achieved by the disclosure is to provide an aerosol generating device in which a temperature sensor measures a temperature of a heater and transmits the measured temperature to a controller, and the controller performs multicalibration on the received temperature value to obtain a temperature that is the same or approximately the same as an actual temperature of the heater, and a method for implementing the aerosol generating device.

Solution to Problem

According to an aspect of an example embodiment, there is provided an aerosol generating device including: a heater configured to apply heat to an aerosol generating substrate; a temperature sensor configured to measure a temperature of the heater to obtain a measured temperature value; and a processor configured to: control power supplied to the heater; add a first calibration value to the measured temperature value to obtain a first calibrated temperature value; add a second calibration value to the first calibrated temperature value to obtain a second calibrated temperature value; and determine the second calibrated temperature value as the temperature of the heater.

The processor may be further configured to determine the first calibrated temperature value based on a polynomial equation that is determined based on a change rate of the measured temperature value while the heater is heated.

The polynomial equation may be a quadratic equation.

The processor may be further configured to add the first calibration value in a section that is divided into at least two sections according to a size of the first calibration value.

The processor may be further configured to add the first calibration value in a section that is divided into at least two sections according to a pre-set temporal length.

The first calibration value may be greater than the second calibration value.

The first calibration value may be less than the second calibration value.

The processor may be further configured to determine the first calibration value based on a polynomial equation that is determined based on a change rate of the measured temperature value while the heater is heated, and the second calibration value may be determined based on a criterion except for the polynomial equation.

The processor may be further configured to add the first calibration value in a section that is divided into at least two sections according to a size of the first calibration value, and the second calibration value may be predetermined for each of the at least two sections.

The processor may be further configured to determine the second calibration value by referring to a matching table in which the second calibration value corresponds to each of the at least two sections.

The processor may be further configured to add the first calibration value after the measured temperature value reaches a predetermined temperature.

The processor may be further configured to add the second calibration value after the first calibrated temperature value reaches a predetermined temperature.

According to an aspect of another example embodiment, there is provided a method of operating an aerosol generating device, the method including: measuring a temperature of a heater configured to apply heat to an aerosol generating substrate, to obtain a measured temperature value; adding a first calibration value to the measured temperature value to obtain a first calibrated temperature value; adding a second calibration value to the first calibrated temperature value to obtain a second calibrated temperature value; and determining the second calibrated temperature value as the temperature of the heater.

The first calibrated temperature value may be determined based on a polynomial equation that is determined based on a change rate of the measured temperature value while the heater is heated.

The polynomial equation may be a quadratic equation.

The adding the first calibration value may include: adding the first calibration value in a section that is divided into at least two sections according to a size of the first calibration value.

The adding the first calibration value may include: adding the first calibration value in a section that is divided into at least two sections according to a pre-set temporal length.

The first calibration value may be greater than the second calibration value.

The first calibration value may be determined based on a polynomial equation that is determined based on a change rate of the measured temperature value while the heater is heated. The second calibration value may be determined based on a criterion except for the polynomial equation.

According to an aspect of another example embodiment, there is provided a nontransitory computer-readable recording medium having stored thereon a program for executing the method of operating the aerosol generating device.

Advantageous Effects of Invention

According to embodiments of the disclosure, a temperature of a heater may be reliably and accurately obtained by performing multicalibration on a temperature of the heater that is measured by a temperature sensor.

BRIEF DESCRIPTION OF DRAWINGS

The above and/or other aspects will be more apparent by describing certain example embodiments, with reference to the accompanying drawings, in which:

FIGS. 1 and 2 are diagrams showing examples in which a cigarette is inserted into an aerosol generating device according to example embodiments;

FIG. 3 is a diagram illustrating another example in which a cigarette is inserted into an aerosol generating device according to an example embodiment;

FIG. 4 is a diagram illustrating a cigarette according to an example embodiment;

FIG. 5 is a diagram illustrating a cigarette according to another example embodiment;

FIG. 6 is a diagram illustrating a double medium cigarette used in the device of FIG. 3 according to an example embodiment;

FIG. 7 is a perspective view of an aerosol generating device including a liquid cartridge according to an example embodiment;

FIG. 8 is a perspective view of an aerosol generating device according to an example embodiment;

FIG. 9 is a side view of the device described in FIG. 8 according to an example embodiment;

FIG. 10 is a block diagram illustrating a controller of an aerosol generating device according to an example embodiment;

FIG. 11 is a diagram intuitively showing a difference between a temperature of the heater that is measured by a temperature sensor and an actual temperature a the heater;

FIG. 12 shows an example, in which a temperature of the heater, to which a first calibration value is added, is determined by a polynomial equation determined based on a change rate of a temperature measured by the temperature sensor, according to an example embodiment;

FIG. 13 is a schematic graph of the temperature of the heater, to which the first calibration value is added according to an example embodiment, and the actual temperature of the heater;

FIG. 14 is a diagram for describing a second calibration value according to an example embodiment;

FIG. 15 is a flowchart illustrating a method of performing multicalibration on a temperature value measured by a temperature sensor, according to an example embodiment; and FIG. 16 is a flowchart illustrating a method of performing multicalibration on a temperature value measured by a temperature sensor, according to another example embodiment.

BEST MODE FOR CARRYING OUT THE INVENTION

A device according to an embodiment of the disclosure for solving the technical problem described above includes: a heater configured to generate an aerosol by heating an aerosol generating substrate; a temperature sensor configured to measure a temperature of the heater; and a controller configured to control power supplied to the heater, wherein the controller is further configured to: add a first calibration value to the temperature measured by the temperature sensor; and determine a temperature, as a final temperature of the heater, by further adding a second calibration value to the temperature to which the first calibration value is added.

In the device, the temperature to which the first calibration value is added may be determined based on a polynomial equation determined based on a change rate of the temperature measured by the temperature sensor while the heater is heated.

In the device, the polynomial equation may be a quadratic equation.

In the device, sections in which the first calibration value is added may be divided into at least two sections, according to a size of the first calibration value.

In the device, sections in which the first calibration value is added may be divided into at least two sections, according to a temporal length that is pre-set.

In the device, the first calibration value may be greater than the second calibration value.

In the device, the first calibration value may be less than the second calibration value.

In the device, the first calibration value may be determined based on a polynomial equation determined based on a change rate of the temperature measured by the temperature sensor while the heater is heated, and the second calibration value may be determined based on a criterion except for the polynomial equation.

In the device, sections in which the first calibration value is added may be divided into at least two sections, according to a size of the first calibration value, and the second calibration value may be predetermined for each of the at least two sections.

In the device, the controller may further be configured to determine the second calibration value by referring to a matching table in which the second calibration value corresponds to each of the at least two sections.

In the device, the first calibration value may be added after the temperature measured by the temperature sensor reaches a predetermined temperature.

In the device, the second calibration value may be added after the temperature to which the first calibration value is added reaches a predetermined temperature.

A method according to another embodiment of the disclosure for solving the technical problem described above includes: receiving a temperature of a heater configured to generate an aerosol by heating an aerosol generating substrate, from a temperature sensor; adding a first calibration value to the received temperature; and further adding a second calibration value to the temperature to which the first calibration value is added.

In the method, the temperature to which the first calibration value is added may be determined based on a polynomial equation determined based on a change rate of the temperature measured by the temperature sensor while the heater is heated.

In the method, the polynomial equation may be a quadratic equation.

In the method, sections in which the first calibration value is added may be divided into at least two sections, according to a size of the first calibration value.

In the method, sections in which the first calibration value is added may be divided into at least two sections, according to a temporal length that is pre-set.

In the method, the first calibration value may be greater than the second calibration value.

In the method, the first calibration value may be determined based on a polynomial equation determined based on a change rate of the temperature measured by the temperature sensor while the heater is heated, and the second calibration value may be determined based on a criterion except for the polynomial equation.

A computer-readable recording medium according to an embodiment has stored thereon a program for executing the method described above.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedent, the appearance of new technology, and the like. There are terms discretionally selected by an applicant on particular occasions. These terms will be explained in detail in relevant description. Therefore, terms used herein are not just names but should be defined based on the meaning of the terms and the whole content of the present disclosure.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

The attached drawings for illustrating one or more embodiments are referred to in order to gain a sufficient understanding, the merits thereof, and the objectives accomplished by the implementation. The disclosure may, however, be embodied in many different forms and should not be construed as being limited to the embodiments set forth herein.

Hereinafter, embodiments of the present disclosure will be described in detail with reference to the drawings.

FIGS. 1 and 2 are diagrams showing examples in which a cigarette is inserted into an aerosol generating device.

Referring to FIGS. 1 and 2, an aerosol generating device 10 includes a battery 120, a controller 110, a heater 130 and a vaporizer 180. A cigarette 200 may be inserted into an internal space of the aerosol generating device 10.

The elements related to the embodiment are illustrated in the aerosol generating device 10 of FIGS. 1 to 2. Therefore, one of ordinary skill in the art would appreciate that other universal elements than the elements shown in FIGS. 1 to 2 may be further included in the aerosol generating device 10.

In addition, although it is shown that the heater 130 is included in the aerosol generating device 10 in FIGS. 1 and 2, the heater 130 may be omitted if necessary.

In FIG. 1, the battery 120, the controller 110, the heater 130 and the vaporizer 180 are arranged in a row. Also, FIG. 2 shows that the vaporizer 180 and the heater 130 are arranged in parallel with each other. However, an internal structure of the aerosol generating device 10 is not limited to the examples shown in FIG. 1 or 2. That is, according to a design of the aerosol generating device 10, arrangement of the battery 120, the controller 110, the heater 130, and the vaporizer 180 may be changed.

When the cigarette 200 is inserted into the aerosol generating device 10, the aerosol generating device 10 operates the heater 130 and/or the vaporizer 180 to generate aerosol from the cigarette 200 and/or the vaporizer 180. The aerosol generated by the vaporizer 180 may be transferred to a user via the cigarette 200. The vaporizer 180 will be described in more detail below.

The battery 120 supplies the electric power used to operate the aerosol generating device 10. For example, the battery 120 may supply power for heating the heater 130 or the vaporizer 180 and supply power for operating the controller 110. In addition, the battery 120 may supply power for operating a display, a sensor, a motor, and the like installed in the aerosol generating device 10.

The controller 110 controls the overall operation of the aerosol generating device 10. In detail, the controller 110 may control operations of other elements included in the aerosol generating device 10, as well as the battery 120, the heater 130, and the vaporizer 180. Also, the controller 110 may check the status of each component in the aerosol generating device 10 to determine whether the aerosol generating device 10 is in an operable state.

The controller 110 includes at least one processor. A processor can be implemented as an array of a plurality of logic gates or can be implemented as a combination of a general-purpose microprocessor and a memory in which a program executable in the microprocessor is stored. It will be understood by one of ordinary skill in the art that the present disclosure may be implemented in other forms of hardware.

The heater 130 may be heated by the electric power supplied from the battery 120. For example, when the cigarette 200 is inserted in the aerosol generating device 10, the heater 130 may be located outside the cigarette 200. Therefore, the heated heater 130 may raise the temperature of an aerosol generating material in the cigarette 200.

The heater 130 may be an electro-resistive heater. For example, the heater 130 includes an electrically conductive track, and the heater 130 may be heated as a current flows through the electrically conductive track. However, the heater 130 is not limited to the above example, and any type of heater may be used provided that the heater is heated to a desired temperature. Here, the desired temperature may be set in advance on the aerosol generating device 10, or may be set by a user.

In addition, in another example, the heater 130 may include an induction heating type heater. In detail, the heater 130 may include an electrically conductive coil for heating the cigarette 200 in an induction heating method, and the cigarette 200 may include a susceptor that may be heated by the induction heating type heater.

In the FIGS. 1 and 2, the heater 130 is shown to be disposed outside the cigarette 200, but is not limited thereto. For example, the heater 130 may include a tubular heating element, a plate-shaped heating element, a needle-shaped heating element, or a rodshaped heating element. And the inside or outside of the cigarette 200 may be heated by the heating element.

Also, there may be a plurality of heaters 130 in the aerosol generating device 10. Here, the plurality of heaters 130 may be arranged to be inserted into the cigarette 200 or on the outside of the cigarette 200. Also, some of the plurality of heaters 130 may be arranged to be inserted into the cigarette 200 and the other may be arranged on the outside of the cigarette 200. In addition, the shape of the heater 130 is not limited to the example shown in FIGS. 1 and 2, but may be manufactured in various shapes.

The vaporizer 180 may generate aerosol by heating a liquid composition, and the generated aerosol may be delivered to the user after passing through the cigarette 200. In other words, the aerosol generated by the vaporizer 180 may move along an air flow passage of the aerosol generating device 10, and the air flow passage may be configured for the aerosol generated by the vaporizer 180 to be delivered to the user through the cigarette 200.

For example, the vaporizer 180 may include a liquid storage unit, a liquid delivering unit, and a heating element, but is not limited thereto. For example, the liquid storage unit, the liquid delivering unit, and the heating element may be included in the aerosol generating device 10 as independent modules.

The liquid storage may store a liquid composition. For example, the liquid composition may be a liquid including a tobacco-containing material having a volatile tobacco flavor component, or a liquid including a non-tobacco material. The liquid storage unit may be attached to/detached from the vaporizer 180 or may be integrally manufactured with the vaporizer 180.

For example, the liquid composition may include water, solvents, ethanol, plant extracts, flavorings, flavoring agents, or vitamin mixtures. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol former such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivering unit. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 180 may be referred to as a cartomizer or an atomizer, but is not limited thereto.

The aerosol generating device 10 may further include universal elements, in addition to the battery 120, the controller 110, the heater 130, and the vaporizer 180. For example, the aerosol generating device 10 may include a display capable of outputting visual information and/or a motor for outputting tactile information. In addition, the aerosol generating device 10 may include at least one sensor (a puff sensor, a temperature sensor, a cigarette insertion sensor, etc.) Also, the aerosol generating device 10 may be manufactured to have a structure, in which external air may be introduced or internal air may be discharged even in a state where the cigarette 200 is inserted.

Although not shown in FIGS. 1 and 2, the aerosol generating device 10 may configure a system with an additional cradle. For example, the cradle may be used to charge the battery 120 of the aerosol generating device 10. Alternatively, the heater 130 may be heated in a state in which the cradle and the aerosol generating device 10 are coupled to each other.

The cigarette 200 may be similar to a typical burning cigarette. For example, the cigarette 200 may include a first portion containing an aerosol generating material and a second portion including a filter and the like. Alternatively, the second portion of the cigarette 200 may also include the aerosol generating material. For example, an aerosol generating material made in the form of granules or capsules may be inserted into the second portion.

The entire first portion may be inserted into the aerosol generating device 10 and the second portion may be exposed to the outside. Alternatively, only a portion of the first portion may be inserted into the aerosol generating device 10 or the entire first portion and a portion of the second portion may be inserted into the aerosol generating device 10. The user may puff aerosol while holding the second portion by the mouth of the user. At this time, the aerosol is generated as the outside air passes through the first portion, and the generated aerosol passes through the second portion and is delivered to a user's mouth.

For example, the outside air may be introduced through at least one air passage formed in the aerosol generating device 10. For example, the opening and closing of the air passage formed in the aerosol generating device 10 and/or the size of the air passage may be adjusted by a user. Accordingly, the amount of smoke and a smoking impression may be adjusted by the user. In another example, the outside air may be introduced into the cigarette 200 through at least one hole formed in a surface of the cigarette 200.

FIG. 3 is a diagram illustrating a cigarette is inserted into an aerosol generating device according to an example embodiment.

When FIG. 3 is compared with the aerosol generating apparatus described through FIGS. 1 and 2, it can be seen that the vaporizer 180 is omitted. Since the element that performs the function of the vaporizer 180 is included in the double medium cigarette 300 inserted into the aerosol generating device shown in FIG. 3, the aerosol generating device shown in FIG. 3 may not include the vaporizer 180.

When the double medium cigarette 300 is inserted into the aerosol generating device 10 in FIG. 3, the double medium cigarette 300 is externally heated, so that a user inhalable aerosol can be generated from the double medium cigarette 300. Also, the double medium cigarette 300 will be described in FIG. 6.

Hereinafter, an example of the cigarette 200 will be described with reference to FIG. 4.

FIG. 4 is a diagram illustrating a cigarette according to an example embodiment of the present disclosure.

Referring to FIG. 4, the cigarette 200 includes a tobacco rod 210 and a filter rod 220. The first portion described above with reference to FIGS. 1 and 2 include the tobacco rod 210 and the second portion includes the filter rod 220.

In FIG. 4, the filter rod 220 is shown as a single segment, but is not limited thereto. In other words, the filter rod 220 may include a plurality of segments. For example, the filter rod 220 may include a first segment for cooling down the aerosol and a second segment for filtering a predetermined component included in the aerosol. Also, if necessary, the filter rod 220 may further include at least one segment performing another function.

The cigarette 200 may be packaged by at least one wrapper 240. The wrapper 240 may include at least one hole through which the outside air is introduced or inside air is discharged. For example, the cigarette 200 may be packaged by one wrapper 240. In another example, the cigarette 200 may be packaged by two or more wrappers 240. For example, the tobacco rod 210 may be packaged by a first wrapper and the filter rod 220 may be packaged by a second wrapper. In addition, the tobacco rod 210 and the filter rod 220 are respectively packaged by single wrappers, and then, the cigarette 200 may be entirely re-packaged by a third wrapper. When each of the tobacco rod 210 and the filter rod 220 includes a plurality of segments, each of the segments may be packaged by a single wrapper. In addition, the cigarette 200, in which the segments respectively packaged by the single wrappers are coupled to one another, may be repackaged by another wrapper.

The tobacco rod 210 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. In addition, the tobacco rod 210 may include other additive materials like a flavoring agent, a wetting agent, and/or an organic acid. Also, a flavoring liquid such as menthol, humectant, etc. may be added to the tobacco rod 210 by being sprayed to the tobacco rod 210.

The tobacco rod 210 may be manufactured variously. For example, the tobacco rod 210 may be fabricated as a sheet or a strand. Also, the tobacco rod 210 may be fabricated by tobacco leaves that are obtained by fine-cutting a tobacco sheet. Also, the tobacco rod 210 may be surrounded by a heat conducting material. For example, the heat-conducting material may be, but is not limited to, a metal foil such as aluminum foil. For example, the heat conducting material surrounding the tobacco rod 210 may improve a thermal conductivity applied to the tobacco rod by evenly dispersing the heat transferred to the tobacco rod 210, and thus, improving tobacco taste. Also, the heat conducting material surrounding the tobacco rod 210 may function as a susceptor that is heated by an inducting heating-type heater. Although not shown in the drawings, the tobacco rod 210 may further include a susceptor, in addition to the heat conducting material surrounding the outside thereof.

The filter rod 220 may be a cellulose acetate filter. In addition, the filter rod 220 is not limited to a particular shape. For example, the filter rod 220 may be a cylinder-type rod or a tube-type rod including a cavity therein. Also, the filter rod 220 may be a recess type rod. When the filter rod 220 includes a plurality of segments, at least one of the plurality of segments may have a different shape from the others.

The filter rod 220 may be manufactured to generate flavor. For example, a flavoring liquid may be sprayed to the filter rod 220 or separate fibers on which the flavoring liquid is applied may be inserted in the filter rod 220.

Also, the filter rod 220 may include at least one capsule 230. Here, the capsule 230 may generate flavor or may generate aerosol. For example, the capsule 230 may have a structure, in which a liquid containing a flavoring material is wrapped with a film. The capsule 230 may have a circular or cylindrical shape, but is not limited thereto.

When the filter rod 220 includes a segment for cooling down the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above examples, and may include any material provided that a function of cooling down the aerosol is implemented.

Although not shown in FIG. 4, the cigarette 200 according to the embodiment may further include a front-end filter. The front-end filter is at a side facing the filter rod 220, in the tobacco rod 210. The front-end filter may prevent the tobacco rod 210 from escaping to the outside and may prevent the liquefied aerosol from flowing to the aerosol generating device 10 (see FIGS. 1 to 2) from the tobacco rod 210 during smoking.

FIG. 5 is a view illustrating another example of a cigarette.

Referring to FIG. 5, it can be seen that the cigarette 200 has a form in which a cross tube 205, the tobacco rod 210, a tube 220*a*, and a filter 220*b* are wrapped by the final wrapper 240. In FIG. 5, the wrapper includes individual wrappers that are individually wrapped around the cross tube 205, the tobacco rod 210, the tube 220*a*, and the filter 220*b*, and a final wrapper that is collectively wrapped around the cross tube 205, the tobacco rod 210, the tube 220*a*, and the filter 220*b*.

The first portion described as containing an aerosol generating material with reference to FIGS. 1 and 2, may include the cross tube 205 and the tobacco rod 210. The second portion described as including a filter with reference to FIGS. 1 and 2, may include the filter rod 220. For the sake of convenient description, the following description will be made with reference to FIGS. 1 and 2, and description overlapping with the description made with reference to FIG. 4 will be omitted.

The cross tube 205 refers to a cross-shaped tube connected to the tobacco rod 210.

The tobacco rod 210 includes an aerosol generating substrate that generates an aerosol when heated by the heater 130 of the aerosol generation device 10.

The tube 220*a* may transfer an aerosol generated when an aerosol generating substrate of the tobacco rod 210 is heated by receiving the sufficient amount of energy from the heater 130 to the filter 220*b*. The tube 220*a* is manufactured in a manner in which triacetin (TA) which a plasticizer is added to a cellulose acetate tow by more than a certain amount to form a circle. The tube 220*a* may be different in shape and may also have a difference in arrangement in that the tobacco rod 210 and the filter 220*b* are connected to each other, as compared with the cross tube 205.

When the aerosol generated by the tobacco rod 210 is transferred through the tube 220*a*, the filter 220*b* is provided to allow a user to puff the aerosol filtered by the filter 220*b* by passing the aerosol therethrough. The filter 220*b* may include a cellulose acetate filter manufactured based on a cellulose acetate tow.

The final wrapper 240 is paper that is wrapped around the cross tube 205, the tobacco rod 210, the tube 220*a*, and the filter 220*b*, and may include all of a cross tube wrapper 240*b*, a tobacco rod wrapper 240*c*, a tube wrapper 240*d*, and a filter wrapper 240*e*.

In FIG. 5, the cross tube wrapper 240*b* is wrapped by an aluminum wrapper, the tube 220*a* is wrapped by an MFW or 24K wrapper, and the filter 220*b* is wrapped by an oil-resistant hard wrapper or a lamination of a poly lactic acid (PLA) material. The tobacco rod wrapper 240*c* and the final wrapper 240 will be described in more detail below.

The tobacco rod wrapper 240*c* wraps around the tobacco rod 210 and may be coated with a thermal conductivity enhancement material to maximize efficiency of thermal energy transferred by the heater 130. For example, the tobacco rod wrapper 240*c* may be manufactured in a manner in which a general wrapper or heterotype base paper is coated with at least one of silver foil (Ag), aluminum foil (Al), copper foil (Cu), carbon paper, filler, ceramic (AlN, $Al_2O_3$), silicon carbide, sodium citrate (Na citrate), potassium citrate (K citrate), aramid fiber, nano cellulose, mineral paper, glassine paper, single-walled carbon nanotube (SWNT). A general wrapper refers to a wrapper applied to widely known cigarettes and refers to a porous wrapper made of a proven material that has both paper manufacturing workability and a thermal conductivity exceeding a certain value through a water paper test.

In addition, in the present disclosure, the final wrapper 240 may be manufactured in a manner in which an MFW (a kind of sterilized paper) base paper is coated with at least one of filler, ceramic, silicon carbide, sodium citrate, potassium citrate, aramid fiber, nano cellulose, and SWNT among various materials coating the tobacco rod wrapper 240*c*.

The heater 130 included in the externally heated aerosol generation device 10 described in FIGS. 1 and 2 is a target controlled by the controller 110, and heats the aerosol generating substrate included in the tobacco rod 210 to generate an aerosol, and at this time, thermal energy transferred to the tobacco rod 210 is composed of a ratio of 75% by radiant heat, 15% by convective heat, and 10% by conductive heat. The ratio between the radiant heat, the convective heat, and the conductive heat constituting the thermal energy transferred to the tobacco rod 210 may be different depending on the embodiment.

In the present disclosure, in order to speed up the thermal energy transfer from the heater 130 to an aerosol generating substrate which may be placed apart from the heater 130 rather than having direct contact, the tobacco rod wrapper 240*c* and the final wrapper 240 are coated with a thermal conductivity enhancement material to prompt an efficient transfer of the thermal energy to the aerosol generating substrate of the tobacco rod 210, and thus, a sufficient amount of aerosol may be provided to a user even during an initial puff before the heater 130 is sufficiently heated.

Depending on an embodiment, only one of the tobacco rod wrapper 240*c* and the final wrapper 240 may also be coated with a thermal conductivity enhancement material, and the present disclosure may also be implemented in a manner in which the tobacco rod wrapper 240*c* or the final wrapper 240 is coated with organic metal, inorganic metal, fiber, or polymer material which has a thermal conductivity of a preset value, as well as the above-described examples.

FIG. 6 is an example of a double medium cigarette used in the device of FIG. 3.

In FIG. 6, the double medium cigarette is named for the purpose of distinguishing from the cigarettes described in FIGS. 4 and 5, also for concise description of embodiments of the present disclosure.

Referring to FIG. 6, the double medium cigarette 300 has an aerosol base portion 310, a medium portion 320, cooling portion 330, and the filter portion 340, which are wrapped by the final wrapper 350. The aerosol base portion 310, the medium portion 320, and the filter portion 340 are wrapped by individual wrappers 310*a*, 320*a*, 340*a*, and then wrapped by the final wrapper 350.

The aerosol base portion 310 is formed into a predetermined shape by containing a humectant in pulp-based paper. The aerosol base portion 310 may include propylene glycol or glycerin as the humectant. The humectant of the aerosol base portion 310 may include, propylene glycol and glycerin having a certain weight ratio to the weight of the base paper. When the double medium cigarette 300 is inserted into the aerosol generating device 10 of FIG. 3, the aerosol base portion 310 is located closest to the heater 130.

The medium portion 320 includes one or more of a sheet, a strand, and tobacco leaves that are obtained by fine-cutting a tobacco sheet, and is a portion that generates nicotine to provide a smoking experience to a user. The medium portion 320 is not directly heated by the heater 130 when the double medium cigarette 300 is inserted into the aerosol generating device 10 of FIG. 3 because the aerosol base portion 310 is placed between the heater 130 and the medium portion 320 and therefore the heat is transferred indirectly to the medium portion 320 through the aerosol base portion 310. In the present embodiment, in consideration of the characteristic that the temperature to which the medium contained in the medium portion 320 must reach is lower than the temperature to which the humectant included in the aerosol base portion 310 must reach, the aerosol base portion 310 is heated with the heater 130 to indirectly increase the temperature of the medium portion 320. When the medium portion 320 is heated to a certain temperature by the heater 130, it generates nicotine vapor.

According to a specific embodiment, when the double medium cigarette 300 is inserted into the aerosol generating device 10 of FIG. 3, a part of the medium portion 320 may face the heater 130.

The cooling portion 330 is made of a tube filter containing a plasticizer with a predetermined weight. The moisture vapor from the aerosol base portion 310 and the nicotine vapor from the medium portion 320 are mixed to be aerosolized, and are cooled while passing through the cooling portion 330.

The filter portion 340 may be a cellulose acetate filter, and the filter portion 340 is not limited to a particular shape. For example, the filter portion 340 may be a cylinder-type rod or a tube-type rod including a cavity therein. When the filter portion 340 includes a plurality of segments, at least one of the plurality of segments may have a different shape from the others. The filter portion 340 may be manufactured to generate flavor. For example, a flavoring liquid may be sprayed to the filter portion 340 or separate fibers on which the flavoring liquid is applied may be inserted in the filter portion 340.

Also, the filter portion 340 may include at least one capsule. Here, the capsule may generate flavor or may generate aerosol. For example, the capsule may have a structure, in which a liquid containing a flavoring material is wrapped with a film. The capsule may have a circular or cylindrical shape, but is not limited thereto.

The final wrapper 350 means a wrapper that wraps the aerosol base portion 310, the medium portion 320, and the filter portion 340 which are wrapped by individual wrappers 310*a*, 320*a*, and 340*a*.

FIG. 7 is a perspective view of an aerosol generating device including a liquid cartridge according to an example embodiment.

FIG. 7 is an exploded perspective view schematically illustrating a coupling relationship between a replaceable cartridge 750 containing an aerosol generating material and an aerosol generating device 700 including the replaceable cartridge 750, according to an embodiment. An aerosol generating device 700 according to the embodiment illustrated in FIG. 7 includes the replaceable cartridge 750 containing the aerosol generating material and a main body 710 supporting the replaceable cartridge 750.

The replaceable cartridge 750 may be coupled to the main body 710 in a state in which the aerosol generating material is accommodated therein. A portion of the replaceable cartridge 750 is inserted into an accommodation space of the main body 710 so that the replaceable cartridge 750 may be mounted on the main body 710.

The replaceable cartridge 750 may contain an aerosol generating material in any one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 10, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The replaceable cartridge 750 is operated by an electrical signal or a wireless signal transmitted from the main body 710 to generate aerosol by converting the phase of the aerosol generating material inside the replaceable cartridge 750 to a gaseous phase. The aerosol may refer to a gas in which vaporized particles generated from an aerosol generating material are mixed with air.

For example, the replaceable cartridge 750 may convert the phase of the aerosol generating material by receiving the electrical signal from the main body 710 and heating the aerosol generating material, or by using an ultrasonic vibration method, or by using an induction heating method. As another example, when the replaceable cartridge 750 includes its own power source, the replaceable cartridge 750 may generate aerosol by being operated by an electric control signal or a wireless signal transmitted from the main body 710 to the replaceable cartridge 750.

The replaceable cartridge 750 may include a liquid storage accommodating the aerosol generating material therein, and an atomizer that converts the aerosol generating material of the liquid storage to aerosol.

When the liquid storage "accommodates the aerosol generating material" therein, it means that the liquid storage functions as a container simply holding an aerosol generating material and that the liquid storage includes therein an element impregnated with (containing) an aerosol generating material, such as a sponge, cotton, fabric, or porous ceramic structure.

The atomizer may include, for example, a liquid delivery element (wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like, and may be implemented by a conductive filament, wound on the liquid delivery element, or arranged adjacent to the liquid delivery element, by using a material such as a nichrome wire.

In addition, the atomizer may be implemented by a heating element in the form of a mesh or plate, which performs both the functions of absorbing the aerosol generating material and maintaining the same in an optimal state for conversion to aerosol without using a separate liquid delivery element and the function of generating aerosol by heating the aerosol generating material.

At least a portion of the liquid storage of the replaceable cartridge 750 may include a transparent material so that the aerosol generating material accommodated in the replaceable cartridge 750 may be visually identified from the outside. The liquid storage includes a protruding window protruding from the liquid storage, so that the liquid storage may be inserted into a groove of the main body 710 when coupled to the main body 710. A mouthpiece and the liquid storage may be entirely formed of transparent plastic or glass, and only the protruding window corresponding to a portion of the liquid storage may be formed of a transparent material.

The main body 710 includes a connection terminal arranged inside the accommodation space. When the liquid storage of the replaceable cartridge 750 is inserted into the accommodation space of the main body 710, the main body 710 may provide power to the replaceable cartridge 750 through the connection terminal or supply a signal related to an operation of the replaceable cartridge 750 to the replaceable cartridge 750.

The mouthpiece is coupled to one end of the liquid storage of the replaceable cartridge 750. The mouthpiece is a portion of the aerosol generating device 700, which is to be inserted into a user's mouth. The mouthpiece includes a discharge hole for discharging aerosol generated from the aerosol generating material inside the liquid storage to the outside.

The slider 730 is coupled to the main body 710 to move with respect to the main body 710. The slider 730 covers at least a portion of the mouthpiece of the replaceable cartridge 750 coupled to the main body 710 or exposes at least a portion of the mouthpiece to the outside by moving with respect to the main body 710. The slider 730 includes an elongated hole 7*a* exposing at least a portion of the protruding window of the replaceable cartridge 750 to the outside.

The slider 730 has a container shape with a hollow space therein and both ends opened. The structure of The slider 730 is not limited to the container shape as shown in the drawing, and The slider 730 may have a bent plate structure having a clip-shaped cross-section, which is movable with respect to the main body 710 while being coupled to an edge of the main body 710, or a structure having a curved semi-cylindrical shape and a curved arc-shaped cross section.

The slider 730 includes a magnetic body for maintaining the position of the slider 730 with respect to the main body 710 and the replaceable cartridge 750. The magnetic body may include a permanent magnet or a material such as iron, nickel, cobalt, or an alloy thereof.

The magnetic body includes two first magnetic bodies 8*a* facing each other with an inner space of the slider 730 therebetween, and two second magnetic bodies 8*b* facing each other with the inner space of the slider 730 therebetween. The first magnetic bodies 8*a* and the second magnetic bodies 8*b* are arranged to be spaced apart from each other along a longitudinal direction of the main body 710, which is a moving direction of the slider 730, that is, the direction in which the main body 710 extends.

The main body 710 includes a fixed magnetic body arranged on a path along which the first magnetic bodies and the second magnetic bodies of the slider 730 move while The slider 730 moves with respect to the main body 710. Two fixed magnetic bodies of the main body 710 may be mounted to face each other with the accommodation space therebetween.

Depending on the position of the slider 730, the slider 730 may be stably maintained in a position where an end of the mouthpiece is covered or exposed by a magnetic force acting between the fixed magnetic body and the first magnetic body or between the fixed magnetic body and the second magnetic body.

The main body 710 includes a position change detecting sensor arranged on the path along which the first magnetic body and the second magnetic body of the slider 730 move while the slider 730 moves with respect to the main body 710. The position change detecting sensor may include, for example, a Hall IC using the Hall effect that detects a change in a magnetic field and generates a signal.

In the aerosol generating device 700 according to the above-described embodiments, the main body 710, the replaceable cartridge 750, and the slider 730 have approximately rectangular cross-sectional shapes in a direction transverse to the longitudinal direction, but in the embodiments, the shape of the aerosol generating device 700 is not limited. The aerosol generating device 700 may have, for example, a cross-sectional shape of a circle, an ellipse, a square, or various polygonal shapes. In addition, the aerosol generating device 700 is not necessarily limited to a structure that extends linearly when extending in the longitudinal direction, and may extend a long way while being curved in a streamlined shape or bent at a preset angle in a specific area to be easily held by the user.

FIG. 8 is a perspective view of an example of an aerosol generating device according to the present embodiment.

Referring to FIG. 8, it may be seen that the aerosol generating device 10 according to the present embodiment includes a controller 110, a battery 120, a heater 130, and a cigarette 200. FIG. 8 shows only a partial configuration of the aerosol generating device 10 for convenience of description. Therefore, it will be apparent to those of ordinary skill in the art that, even if other configurations are added, if the configurations described above are included, it does not depart from the scope of the present embodiment.

In addition, the internal structure of the aerosol generating device 10 is not limited to that shown in FIG. 8, and depending on an embodiment or design, the arrangement of the controller 110, the battery 120, the heater 130, and the cigarette 200 may be different. Description of each element of FIG. 8 has already been given with reference to FIGS. 1 to 3, and thus will be omitted.

FIG. 9 is a side view of the device described in FIG. 8.

Referring to FIG. 9, the aerosol generating device 10 according to the present embodiment includes a PCB 11, a controller 110, a battery 120, a heater 130 and a display 150, and a cigarette insertion space 160. Hereinafter, descriptions that are the same as those of the configuration described with reference to FIG. 1 will be omitted.

The Printed Circuit Board (PCB) 11 may be provided as a substrate for electronically integrating various components that collect information of the aerosol generating device 10 through communication with or under the control of the controller 110. The controller 110 and the display 150 may be fixedly mounted on the surface of the PCB 11, and the battery 120 supplies power to elements connected to the PCB 11.

The display 150 may output information necessary for a user as visual information among information generated by the aerosol generating device 10, and may control information output to an LCD panel (or LED panel) provided on a front side of the aerosol generating device 10 based on information received from the controller 110.

The cigarette insertion space 160 refers to a space that is recessed to a predetermined depth toward the inside of the aerosol generating device 10 so that the cigarette 200 is inserted. The cigarette insertion space 160 has a cylindrical form like the shape of cigarette 200 so that a stick-shaped cigarette 200 is stably mounted, and the height (depth) of the cigarette insertion space 160 may vary depending on the length of the region of the cigarette 200 containing the aerosol-generating material.

For example, if the double medium cigarette 300 described in FIG. 6 is inserted into the cigarette insertion space 160, the height of the cigarette insertion space 160 may be equal to the sum of the lengths of the aerosol substrate portion 310 and the medium portion 320. When the cigarette 200 is inserted into the cigarette insertion space 160, an aerosol may be generated as the heater 130A and 130B adjacent to the cigarette insertion space 160 is heated.

FIG. 10 is a block diagram of the controller 110 included in the aerosol generating device 10, according to an example embodiment.

Referring to FIG. 10, the controller 110 of the aerosol generating device 10 includes a sensor data collector 111, a first offset calculator 113, a second offset calculator 115, and a calibration processor 117. The controller 110, the sensor data collector 111, the first offset calculator 113, the second offset calculator 115, and the calibration processor 117 of FIG. 10 may be included in at least one processor. A processor can be implemented as an array of a plurality of logic gates or can be implemented as a combination of a general-purpose microprocessor and a memory in which a program executable in the microprocessor is stored. Also, it would be understood by one of ordinary skill in the art that the controller 110, the sensor data collector 111, the first offset calculator 113, the second offset calculator 115, and the calibration processor 117 of FIG. 10 may be implemented as different forms of hardware. The processor is implemented in hardware, firmware, or a combination of hardware and software. The at least one processor is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. The processor includes one or more processors capable of being programmed to perform a function.

The sensor data collector 111 collects sensor data from a temperature measured by a temperature sensor 190 configured to measure a temperature of a heater. The sensor data collected by the sensor data collector 111 may include a temperature value of the heater that is measured by the temperature sensor 190.

The first offset calculator 113 calculates a first calibration value (a first offset or a first weight) to be added to or applied to the temperature measured by the temperature sensor 190.

The second offset calculator 115 calculates a second calibration value (a second offset or a second weight) to be added to or applied to the temperature to which the first calibration value is added.

The calibration processor 117 performs general operations for determining a final temperature of the heater by adding the first calibration value to the temperature measured by the temperature sensor 190 or further adding the second calibration value to the temperature to which the first calibration value is added. In an another example embodiment, the calibration processor 117 may apply the first weight and/or the second weight to the measured temperature by multiplying the measured temperature by the first weight and/or the second weight.

The name of each module described above is given to intuitively describe the functions performed by the controller 110. According to embodiments, the name of each module may be changed. Also, it would be understood by one of ordinary skill in the art that the function performed by each module may be solely implemented by the controller 110. Thus, hereinafter, embodiments of the disclosure will be described in detail, and for convenience of explanation, an object performing each function is considered to be the controller 110, unless particularly defined.

The aerosol generating device 10 according to the disclosure includes the heater 130, the temperature sensor 190 configured to measure a temperature of the heater 130, and the controller 110 configured to control power supplied to the heater 130. The controller 110 may add the first calibration value to the temperature measured by the temperature sensor 190 and further add the second calibration value to the temperature to which the first calibration value is added, in order to determine the final temperature of the heater 130.

First, the temperature sensor 190 measures the temperature of the heater 130 and transmits the measured temperature to the controller 110. The temperature of the heater 130 may exceed 300 Celsius degrees, and for maintaining the heating efficiency of the heater 130, the temperature sensor 190 may not be directly coupled to the heater 130 and/or may not have physical contact with the heater 130. Accordingly, the temperature (a measured temperature) of the heater 130 that is measured by the temperature sensor 190 may deviate from an actual temperature of the heater 130.

FIG. 11 is a diagram intuitively showing a difference between a temperature of the heater that is measured by the temperature sensor 190 and an actual temperature of the heater 130.

Referring to FIG. 11, a temperature graph 1110 showing a temperature sensed by the temperature sensor 190 may be higher than an actual temperature graph 1130 showing the actual temperature of the heater 130. That is, FIG. 11 indicates that a temperature of the heater 130 that is measured by the temperature sensor 190 is generally higher than an actual temperature of the heater 130, and for the controller 110 to be able to properly rely on the temperature value of the heater 130 that is measured by the temperature sensor 190, an appropriate calibration value may have to be calculated with respect to the temperature of the heater 130 that is measured by the temperature sensor 190.

In FIG. 11, because the measured temperature of the heater 130 is higher than the actual temperature of the heater 130, the calibration value may be a negative number. However, according to an embodiment, the temperature of the heater 130 that is measured by the temperature sensor 190 may be lower than the actual temperature of the heater 130, and in this case, the calibration value may be a positive number.

According to the disclosure, in order to minimize the deviation described above, the controller 110 may perform calibration at least two times on a measured temperature of the heater 130 and may obtain a temperature value that is approximately the same as the actual temperature of the heater 130 or the same as the actual temperature of the heater 130.

The first calibration value and the second calibration value added by the controller 110 to the temperature of the heater 130 that is measured by the temperature sensor 190, may be calculated by using different methods from each other.

For example, a temperature of the heater 130, to which the first calibration value is added, may be a temperature, which is determined by a polynomial equation determined based on a change range of the temperature measured by the temperature sensor 190 while the heater 130 is heated.

FIG. 12 shows an example, in which a temperature of the heater 130, to which a first calibration value is added, is determined by a polynomial equation determined based on a change rate of a temperature measured by the temperature sensor 190.

First, like FIG. 11, (a) of FIG. 12 is a diagram showing a result of comparing a graph of a temperature of the heater 130 that is measured by the temperature sensor 190 and a graph of an actual temperature of the heater 130.

The graphs of (a) of FIG. 12 are divided into a first section 1210, a second section 1230, and a third section 1250. The first section 1210 corresponds to a section in which the temperature of the heater 130 reaches a highest temperature (about 310 Celsius degrees), and then, the temperature is constantly maintained. The second section 1230 corresponds to a section in which the temperature of the heater 130 that is constantly maintained in the first section 1210 drops by a predetermined rate, and then, the dropped temperature is constantly maintained. The third section 1250 corresponds to a section in which the temperature of the heater 130 that is constantly maintained in the second section 1230 drops by a predetermined rate again.

(b) of FIG. 12 shows a graph of a polynomial equation. In detail, (b) of FIG. 12 is the graph of the polynomial equation for calculating the temperature of the heater 130, to which the first calibration value is added. The controller 110 may determine the temperature of the heater 130, to which the first calibration value is added, based on the polynomial equation according to FIG. 12B.

$$y=-0.0004x^2+1.4079x-48.202 \quad \text{[Equation 1]}$$

Equation 1 indicates the polynomial equation with respect to (b) of FIG. 12. In Equation 1, x denotes the temperature of the heater 130, to which the first calibration value is added, and y denotes the temperature of the heater 130 that is measured by the temperature sensor 190. For example, referring to (a) of FIG. 12, the temperature of the heater 130 that is measured by the temperature sensor 190 is maintained as about 349 Celsius degrees in the first section 1210, the temperature of the heater 130 that is measured by the temperature sensor 190 is maintained as about 290 Celsius degrees in the second section 1230, and an average of the temperature of the heater 130 that is measured is about 233 Celsius degrees in the third section 1250. When each of the temperature values, that is, 349, 290, and 233 Celsius degrees, observed in (a) of FIG. 12 is substituted in y of Equation 1, and x is obtained by using an inverse function of Equation 1, respective x values are 310, 260, and 213 Celsius degrees, and these values are the temperatures of the heater 130, to which the first calibration values are added.

That is, in summary of (b) of FIG. 12 and Equation 1, the first calibration value in the first section 1210 in (a) of FIG. 12 is 39 corresponding to a value obtained by subtracting 310 from 349, the first calibration value in the second section 1230 is 30 corresponding to a value obtained by subtracting 260 from 290, and the first calibration value in the third section 1250 is 20 corresponding to a value obtained by subtracting 213 from 233.

Equation 1 is an example of the polynomial equation determined based on the change rate of the temperature measured by the temperature sensor 190. By using the factors that a deviation in the first section 1210 in (a) of FIG. 12 is a value exceeding 35 (e.g., a first preset value), a deviation in the second section 1230 is a value exceeding 30 (e.g., a second preset value), and a deviation in the third section 1250 is a value less than 30, the controller 10 may model the polynomial equation. Also, whenever additional data is accumulated, the controller 110 may correct the pre-stored polynomial equation. Therefore, the polynomial equation referred to by the controller 110 to calculate the first calibration value may become a type of expression that is different from Equation 1. That is, in this disclosure, Equation 1 is a quadratic polynomial equation. However, according to an embodiment, the equation used by the controller 110 to determine the first calibration value may be a type of polynomial equation, which is different from the quadratic polynomial equation.

Also, a criterion for dividing the first section 1210, the second section 1230, and the third section 1250 in (a) of FIG. 12 may not be a size of the first calibration value, but may be a pre-set temporal length. For example, in (a) of FIG. 12, the temperature of the heater 130 keeps rising as the heater 130 is heated and reaches about 310 Celsius degrees (e.g., from Time $T_0$ to Time $T_1$), and after Time $T_1$, the heater 120 is constantly maintained (e.g., from Time $T_1$ to Time $T_2$ corresponding to the first section 1210). Then, the temperature of the heater 130 may gradually decrease from Time $T_2$ to Time $T_3$ in the second section 1230, and from Time $T_1$ to Time $T_4$ in the third section 1250. Here, the temporal length of the first section 1210 may be a value that is pre-stored. The controller 110 may control power that is supplied to the heater 130 with reference to the temporal length that is pre-stored. The power supplied to the heater 130 may be constantly maintained when the temperature is maintained as 310 Celsius degrees in the first section 1210, and when the second section 1230 is started after a time interval, the power supplied to the heater 130 may be reduced. The temporal lengths of the sections that are stored in the controller 110 may be experimentally, empirically, or arithmetically optimized.

According to an embodiment, the controller 110 or the first offset calculator 113 may include a module for modelling Equation 1. By taking into account temporal information about a time point at which the heater 130 is heated, temperature information of the heater 130 that is collected by the temperature sensor 190, a prediction temperature of the heater 130 in a corresponding section, etc., the modelling module included in the controller 110 or the first offset calculator 113 may perform modelling to express a first offset (or a temperature of the heater 130, to which the first offset is applied) as a polynomial equation like Equation 1. The prediction temperature of the heater 130 in a corresponding section may be obtained with reference to a temperature profile (a power profile) stored in the controller 110.

In order to increase the accuracy of the modelling of the polynomial equation, the modelling module according to the disclosure may use a curve fitting algorithm, and may also use various machine learning algorithms, such as a support vector machine or a genetic algorithm. Also, the modelling module may use a modelling result generated from an external terminal, by receiving the result through a communication module provided in the aerosol generating device.

FIG. 13 is a schematic graph of the temperature of the heater 130, to which the first calibration value is added, and the actual temperature of the heater 130. The temperature of the heater 130 to which the first calibration value is added, may be referred to as a first calibrated temperature.

When FIG. 13 is compared with (a) of FIG. 12, the deviation between the first calibrated temperature 1310 of the heater 130 and the actual temperature 1330 of the heater 130 is greatly reduced. For example, the temperature measured by the temperature sensor 190 in the first section 1210 was about 349 Celsius degrees. However, because the first calibration value of −37 Celsius degrees is added, the first calibrated temperature becomes 312 Celsius degrees, which has a slight difference from the actual temperature of 310 Celsius degrees. FIG. 13 illustrates that, in addition to the first section 1210, in the second section 1230 and the third section 1250, the temperature of the heater 130, to which the first calibration value (the first offset) is applied, does not have a great difference from the actual temperature of the heater 130.

FIG. 14 is a diagram for describing a second calibration value.

According to the disclosure, the controller 110 or the second offset calculator 115 may add the second calibration value to the temperature of the heater 130 that is measured by the temperature sensor 190, in addition to the first calibration value, and thus, may relatively more accurately determine the temperature of the heater 130. This configuration takes into account the consideration that due to the characteristics that the first calibration value is determined based on a polynomial equation, it is difficult to perform calibration without errors in all sections during which the heater 130 is heated. Via the two-step calibration, the temperature of the heater 130 that is finally determined may be quite close to or the same as an actual temperature of the heater 130.

The graph of FIG. 14 is different from the graphs described in FIGS. 11 through 13 and is illustrated to describe that although the first calibration value is added to a temperature value measured by the temperature sensor 190, there may be intermittent sections in which the calibrated temperatures are still different from an actual temperature of the heater 130. In detail, in the graph of FIG. 14, a fourth section 1410, a fifth section 1430, and a sixth section 1450 are sections in which although the first calibration value is added, the calibrated temperatures are still different from the actual temperature of the heater 130.

The controller 110 may determine the second calibration value of the fourth section 1410 through the sixth section 1450 by referring to a matching table in which the second calibration value corresponds to each of at least two sections.

TABLE 1

| | TEMPERATURE TO WHICH FIRST CALIBRATION VALUE IS ADDED | ACTUAL TEMPERATURE | SECOND CALIBRATION VALUE |
|---|---|---|---|
| DISCORDANT SECTION 1 | 292 | 290 | −2 |
| DISCORDANT SECTION 2 | 281 | 280 | −1 |
| DISCORDANT SECTION 3 | 249 | 250 | 1 |
| ACCORDANT SECTION 1 | 234.9 | 235 | 0 |
| ACCORDANT SECTION 2 | 234.8 | 235 | 0 |
| ACCORDANT SECTION 3 | 234.5 | 235 | 0 |
| DISCORDANT SECTION 4 | 234.3 | 235 | 1 |
| DISCORDANT SECTION 5 | 234 | 235 | 1 |

Table 1 shows an example of the matching table referred to by the controller 110. Table 1 is the matching table in which the second calibration values are matched according to whether or not the temperature to which the first calibration value is added corresponds to an actual temperature of the heater 130. The controller 110 may determine the second calibration values with respect to the discordant sections by referring to the matching table as shown in Table 1. The second calibration value is experimentally, empirically, or arithmetically calculated and pre-stored in an internal storage device (a memory) of the controller 110. The second calibration value may be updated and stored to derive a relatively better result. For example, referring to FIG. 14 and Table 1, the second calibration value of the fourth section 1410 may be −2, and the second calibration value of the sixth section 1450 may be +1.

When the first calibration value is added to the temperature of the heater 130 that is measured by the temperature sensor 190, the deviation between the temperature of the heater 130 and the actual temperature of the heater 130 may disappear in almost all sections. However, there may be points at which there still is a difference between the temperature to which the first calibration value is added and the actual temperature of the heater 190, due to the level of completion of modelling or abnormalities of a temperature profile. Thus, the controller 110 may control the temperature value to be the same as the actual temperature of the heater 190 in all sections by applying the second calibration value.

As described above, the first calibration value and the second calibration value may be positive numbers or negative numbers. Also, according to a selective embodiment, the first calibration value may be greater than the second calibration value with respect to a measured temperature in the same section. According to another selective embodiment, the first calibration value may be less than the second calibration value with respect to a measured temperature in the same section. The two selective embodiments may be variously realized according to the accuracy of a polynomial equation that is modelled or numerical values of a matching table stored in the controller 110.

According to another example embodiment, the first calibration value may be added after the temperature measured by the temperature sensor reaches a predetermined temperature, and the second calibration value may be added after the temperature to which the first calibration value is added reaches another predetermined temperature. This embodiment takes into account the fact that flavors of aerosol generated by a device tends to be mainly determined according to a temperature maintaining method after a heater reaches the highest temperature. The controller 110 may control at least one of the first calibration value and the second calibration value to be added to the temperature measured by the temperature sensor (or the temperature to which the first calibration value is added) after the temperature of the heater reaches a predetermined temperature.

According to another embodiment, the controller 110 may determine the first calibration value by using a matching table and may determine the second calibration value by using a polynomial equation such as Equation 1. When the first calibration value is determined according to the matching table, the order or the type of the polynomial equation for determining the second calibration value may be changed to a form, via which the controller may relatively more easily perform calculation.

FIG. is a flowchart of an example of a method of performing multicalibration on a temperature value measured by a temperature sensor, according to an example embodiment.

FIG. 15 may be implemented by the aerosol generating device 10 or the controller 110 described with reference to FIGS. 1-10, and thus, descriptions will be given based on the aerosol generating device 10 or the controller 110. Hereinafter, aspects that are the same as the aspects described above will not be described.

The controller 110 may collect a result sensed by a temperature sensor (operation S1510).

The controller 110 may reflect an offset based on a first criterion to the collected result (operation S1530). In operation S1530, the first criterion may be a polynomial equation based on a change rate of a temperature, and the offset based on the first criterion denotes a first calibration value, as described above.

The controller 110 may reflect an offset based on a second criterion to the result in which the offset based on the first criterion is reflected (operation S1550). In operation S1550, the result in which the offset based on the first criterion is reflected denotes a measured temperature of a heater, to which the first calibration value is added, and the offset based on the second criterion denotes a second calibration value.

The controller 110 may determine and output a temperature sensor result that is calibrated according to the offsets that are dually applied (operation S1570). Operation S1570 may be performed by the calibration processor 117 of FIG. 10 as described above.

FIG. 16 is a flowchart illustrating a method performing multicalibration on a temperature value measured by a temperature sensor, according to an example embodiment.

FIG. 16 may be implemented by the aerosol generating device 10 or the controller 110 described with reference to FIGS. 1-10, and thus, descriptions will be given based on the aerosol generating device 10 or the controller 110. Hereinafter, aspects that are the same as the aspects described above will not be described.

The controller 110 may collect a result sensed by a temperature sensor (operation S1610).

The controller 110 may reflect an offset based on a first criterion to the collected result (operation S1630).

The controller 110 may examine whether there is a section for which additional calibration is needed (operation S1650) and may selectively reflect an offset based on a second criterion only in the portion for which the calibration is needed (operation S1670). For example, with respect to a portion for which the second calibration value is 0 or is omitted, the controller 110 may not reflect the offset based on the second criterion, and may selectively reflect the offset, in order to minimize unnecessary operations.

When there is no section for which additional calibration is not required, the controller 110 reflects the offset based on the second criterion with respect to all sections, in which the offset based on the first criterion is reflected (operation S1675).

The controller 110 determines and outputs a temperature sensor result calibrated based on the dually applied offsets (operation S1690).

According to the disclosure, by sensing a material of a heater according to devices, locations and the number of various sensors, and minute temperature differences derived from deviations between components of an aerosol generating device, multicalibration is performed on a temperature of the heater that is sensed by a temperature sensor. Thus, without an IR measuring device embedded, an actual temperature of the heater may be accurately identified, and optimized aerosol may be generated.

One or more embodiments described above may be implemented in the form of a computer program that may be executed on a computer through various components, and such a computer program may be recorded in a computer-readable recording medium. At this time, the computer-readable recording medium may be a magnetic medium (e.g., a hard disk, a floppy disk, and a magnetic tape), an optical recording medium (e.g., a CD-ROM and a DVD), a magneto-optical medium (e.g., a floptical disk), and a hardware device specifically configured to store and execute program instructions (e.g., a ROM, a RAM, and a flash memory).

Meanwhile, the computer program recorded on the medium may be specially designed and configured for example embodiments or may be published and available to one of ordinary skill in computer software. Examples of computer programs include machine language code such as code generated by a compiler, as well as high-level language code that may be executed by a computer using an interpreter or the like.

Specific implementations described in one or more embodiments are examples, and do not limit the scope of one or more embodiments in any way. For brevity of description, descriptions of conventional electronic components, control systems, software, and other functional aspects of the systems may be omitted. Furthermore, the connecting lines, or connectors shown in the various figures presented are intended to represent exemplary functional relationships and/or physical or logical couplings between the various elements, and it should be noted that many alternative or additional functional relationships, physical connections or circuit connections may be present in a practical device. Unless specifically mentioned, such as "essential", "importantly", etc., the components may not be necessary components for application of the present disclosure.

As used herein (in particular, in claims), use of the term "the" and similar indication terms may correspond to both singular and plural. When a range is described in the present disclosure, individual values belonging to the range are applied (unless contrary description) to embodiments of the present disclosure, and each individual value constituting the range is the same as being described in the detailed description of the disclosure. Unless there is an explicit description of the order of the steps constituting the method according to the present disclosure or a contrary description, the steps may be performed in an appropriate order. The present disclosure is not necessarily limited to the description order of the steps. The use of all examples or example terms (for example, etc.) is merely for describing the present disclosure in detail, and the scope of the present disclosure is not limited by the examples or the example terms unless the examples or the example terms are limited by claims. It will be understood by one of ordinary skill in the art that various modifications, combinations, and changes may be made according to the design conditions and factors within the scope of the appended claims or equivalents thereof.

INDUSTRIAL APPLICABILITY

An embodiment of the disclosure may be used to manufacture a next generation electronic cigarette.

The invention claimed is:

1. An aerosol generating device comprising:

a heater configured to apply heat to an aerosol generating substrate;

a temperature sensor configured to measure a temperature of the heater to obtain a measured temperature value; and a processor configured to:

control power supplied to the heater;

add a first calibration value to the measured temperature value to obtain a first calibrated temperature value;

add a second calibration value to the first calibrated temperature value to obtain a second calibrated temperature value; and determine the second calibrated temperature value as the temperature of the heater, wherein the first calibration value is determined based on a polynomial equation that is determined according to a change rate of the measured temperature value while the heater is heated, wherein the first calibration value is added in a section that is divided into at least two sections according to a size of the first calibration value, and wherein the second calibration value is predetermined for each of the at least two sections.

2. The aerosol generating device of claim 1, wherein the polynomial equation is a quadratic equation.

3. The aerosol generating device of claim 1, wherein the first calibration value is greater than the second calibration value.

4. The aerosol generating device of claim 1, wherein the first calibration value is less than the second calibration value.

5. The aerosol generating device of claim 1, wherein the processor is further configured to determine the second calibration value by referring to a matching table in which the second calibration value corresponds to each of the at least two sections.

6. The aerosol generating device of claim 1, wherein the processor is further configured to add the first calibration value after the measured temperature value reaches a predetermined temperature.

7. The aerosol generating device of claim 1, wherein the processor is further configured to add the second calibration value after the first calibrated temperature value reaches a predetermined temperature.

* * * * *